US007454348B1

(12) United States Patent
Kapilow et al.

(10) Patent No.: US 7,454,348 B1
(45) Date of Patent: Nov. 18, 2008

(54) SYSTEM AND METHOD FOR BLENDING SYNTHETIC VOICES

(75) Inventors: David A. Kapilow, Berkeley Heights, NJ (US); Kenneth H. Rosen, Middletown, NJ (US); Juergen Schroeter, New Providence, NJ (US)

(73) Assignee: AT&T Intellectual Property II, L.P., New York, NY (US)

( * ) Notice: Subject to any disclaimer, the term of this patent is extended or adjusted under 35 U.S.C. 154(b) by 870 days.

(21) Appl. No.: 10/755,141

(22) Filed: Jan. 8, 2004

(51) Int. Cl.
*G10L 13/06* (2006.01)

(52) U.S. Cl. ..... 704/269; 704/260; 704/266; 704/258

(58) Field of Classification Search ..... 704/258, 704/260, 270–275, 261, 267, 268, 269
See application file for complete search history.

(56) References Cited

U.S. PATENT DOCUMENTS

| | | | | |
|---|---|---|---|---|
| 4,063,035 | A | 12/1977 | Appelman et al. | |
| 4,214,125 | A | 7/1980 | Mozer et al. | |
| 4,384,169 | A | 5/1983 | Mozer et al. | |
| 4,384,170 | A | 5/1983 | Mozer et al. | |
| 4,788,649 | A | 11/1988 | Shea et al. | |
| 5,278,943 | A * | 1/1994 | Gasper et al. | 704/200 |
| 5,642,466 | A | 6/1997 | Narayan | |
| 5,704,007 | A * | 12/1997 | Cecys | 704/260 |
| 5,792,971 | A | 8/1998 | Timis et al. | |
| 5,860,064 | A * | 1/1999 | Henton | 704/260 |
| 5,893,062 | A | 4/1999 | Bhadkamkar et al. | |
| 6,006,187 | A * | 12/1999 | Tanenblatt | 704/260 |
| 6,181,351 | B1 * | 1/2001 | Merrill et al. | 345/473 |
| 6,377,917 | B1 * | 4/2002 | Gimenez de los Galanes et al. | 704/220 |
| 6,496,797 | B1 | 12/2002 | Redkov et al. | |
| 6,539,354 | B1 * | 3/2003 | Sutton et al. | 704/260 |
| 6,615,174 | B1 * | 9/2003 | Arslan et al. | 704/270 |
| 6,792,407 | B2 * | 9/2004 | Kibre et al. | 704/260 |
| 7,031,924 | B2 * | 4/2006 | Kimura et al. | 704/274 |
| 7,062,437 | B2 * | 6/2006 | Kovales et al. | 704/260 |
| 2001/0049602 | A1 * | 12/2001 | Walker et al. | 704/260 |
| 2002/0049594 | A1 * | 4/2002 | Moore et al. | 704/258 |
| 2004/0054537 | A1 * | 3/2004 | Morio et al. | 704/260 |
| 2005/0086060 | A1 * | 4/2005 | Gleason et al. | 704/278 |

OTHER PUBLICATIONS

Jongho Shin, Shrikanth Narayanan, Laurie Gerber, Abe Kazemzadeh, Dani Byrd, "Analysis of User Behavior under Error Conditions in Spoken Dialogs", University of Southern California—Integrated Media Systems Center ICSLP-2003, pp. 2069-2072, 2003.

(Continued)

*Primary Examiner*—Vijay B Chawan

(57) ABSTRACT

A system and method for generating a synthetic text-to-speech TTS voice are disclosed. A user is presented with at least one TTS voice and at least one voice characteristic. A new synthetic TTS voice is generated by blending a plurality of existing TTS voices according to the selected voice characteristics. The blending of voices involves interpolating segmented parameters of each TTS voice. Segmented parameters may be, for example, prosodic characteristics of the speech such as pitch, volume, phone durations, accents, stress, mis-pronunciations and emotion.

34 Claims, 3 Drawing Sheets

OTHER PUBLICATIONS

Egbert Ammicht, Allen Gorin, Tirso Alonso, 'Knowledge Collection For Language Spoken Dialog Systems', AT&T Laboratories Eurospeech '99, pp. 1375-1378.

Paul C. Constantinides, Alexander I. Rudnicky, "Dialog Analysis In the Carnegie Mellon Communicator", School of Computer Science, Carnegie Mellon University Eurospeech '99, pp. 243-246.

Malte Gabsdil, "Classifying Recognition Results for Spoken Dialog Systems", Department of Computational Linguistics, Saarland University, Germany ACL '03:Proceeding of the 41st Annual meeting on Association for Computational Linguistics, vol. 2, pp. 23-30.

Shrikanth Narayanan, "Towards Modeling User Behavior in Human-Machine Interactions: Effect of Errors and Emotions", University of Southern California—Integrated Media Systems Center, ISLE Workshop on Multimodal Dialog Tagging, Dec. 2002.

* cited by examiner

SYSTEM AND METHOD FOR BLENDING SYNTHETIC VOICES

BACKGROUND OF THE INVENTION

1. Field of the Invention

The present invention relates to synthetic voices and more specifically to a system and method of blending several different synthetic voices to obtain a new synthetic voice having at least one of the characteristics of the different voices.

2. Introduction

Text-to-speech (TTS) systems typically offer the user a choice of synthetic voices from a relatively small number of voices. For example, many systems allow users to select a male or female voice to interact with. When a person desires a voice having a particular feature, a user must select of voice that inherently has that characteristic such as a particular accent. This approach presents challenges for a user who may desire a voice having characteristics that are not available. There are not an unlimited number of TTS voices because each voice is costly and time consuming to generate. Therefore, there are a limited number of voices and voices having specific characteristics.

Given the small number of choices available to the average user when selecting a synthetic voice, there is a need in the art for more flexibility to enable a user to obtain a synthetic voice having the desired characteristics. What is further needed in the art is a system and method of obtaining a desired synthetic voice utilizing existing synthetic voices.

SUMMARY OF THE INVENTION

Additional features and advantages of the invention will be set forth in the description which follows, and in part will be obvious from the description, or may be learned by practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth herein.

In its broadest terms, the present invention comprises a system and method of blending at least a first synthetic voice with a second synthetic voice to generate a new synthetic voice having characteristics of the first and second synthetic voices. The system may comprise a computer server or other computing device storing software operating to control the device to present the user with options to manipulate and receive synthetic voices comprising a blending of a first synthetic voice and a second synthetic voice.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The system and method of the present invention provide a user with a greater range of choice of synthetic voices than may otherwise be available. The use of synthetic voices is increasing in many aspects of human-computer interaction. For example, AT&T's VoiceTone$^{SM}$ service provides a natural language interface for a user to obtain information about a user telephone account and services. Rather than navigating through a complicated touch-tone menu system, the user can simply speak and articulate what he or she desires. The service then responds with the information via a natural language dialog. The text-to-speech (TTS) component of the dialog includes a synthetic voice that the user hears. The present invention provides means for enabling a user to receive a larger selection of synthetic voices to suit the user's desires.

Figure 1:
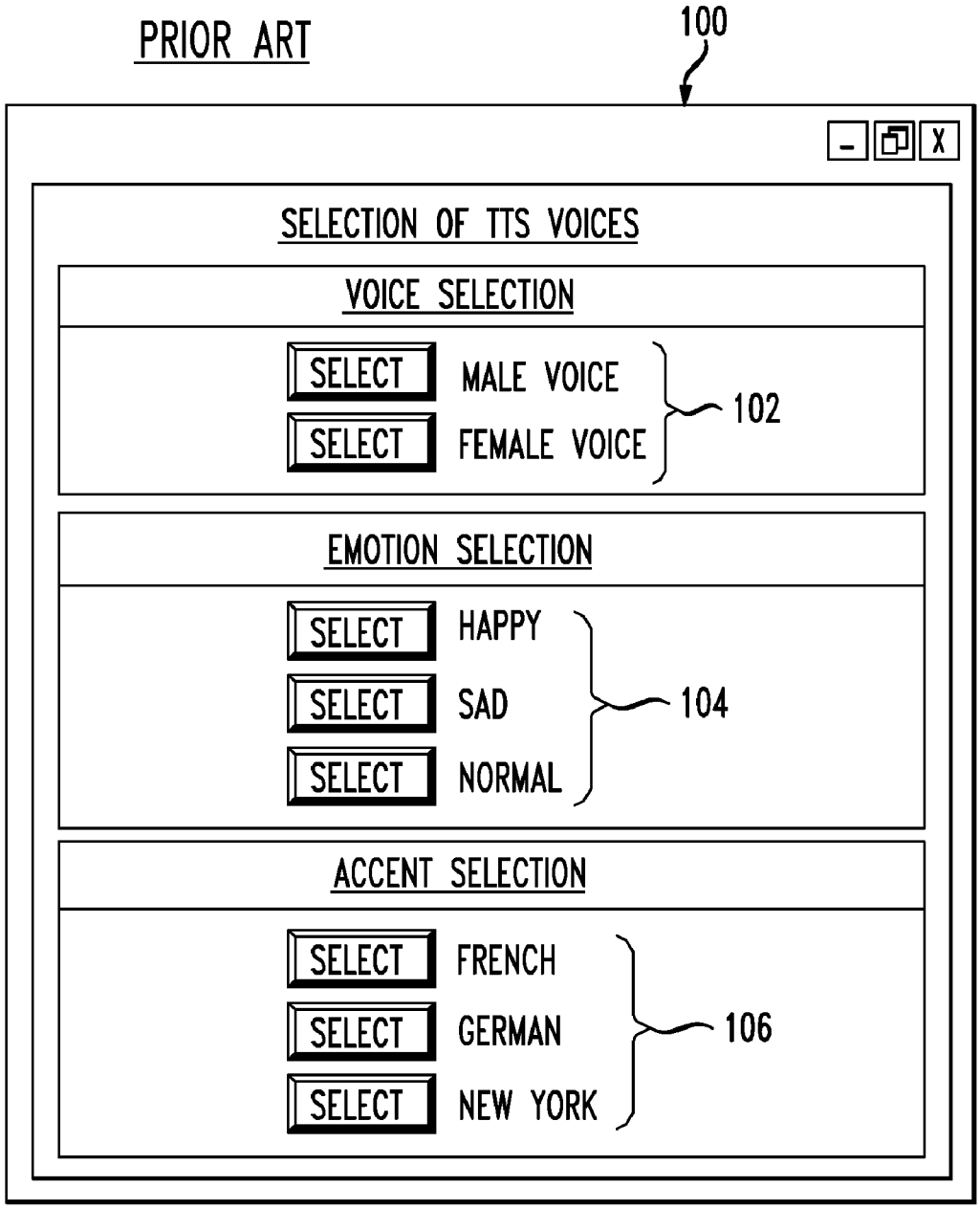
FIG. 1 PRIOR ART
FIG. 1 illustrates a webpage presenting a user with various synthetic voice options for selecting the characteristics of a synthetic voice.

FIG. 1 illustrates a simple example of a graphical user interface such as a web browser where the user has the option in the context of a TTS webpage 100 to select from a plurality of different voices and voice characteristics. Shown are a few samplings of potential choices. Under the voice selection section 102 the user can select from a male voice or a female voice. The emotion selection section 104 presents the user with options to select from a happy, sad or normal emotional state for the voice. An accent selection section 106 presents the user with accents such as French, German or a New York accent for the synthetic voice.

Figure 2:
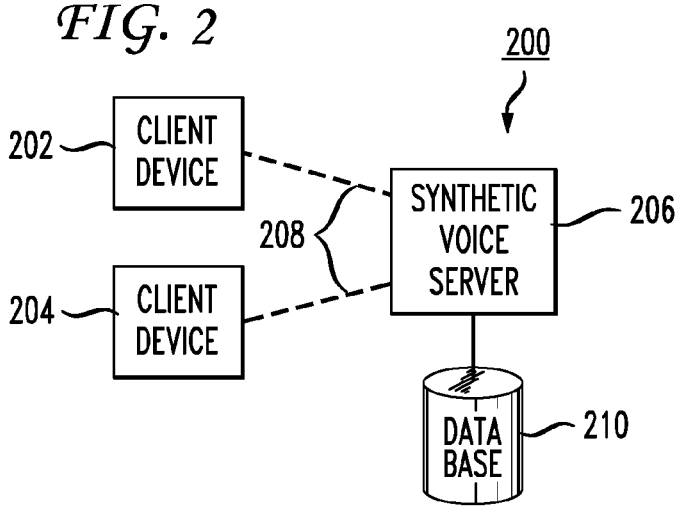
FIG. 2 illustrates a block diagram of the system aspect of the present invention.

FIG. 2 illustrates the general architecture of the invention. A synthetic voice server 206 provides the necessary software to present the user at a client device 202 or 204 with options of synthetic voices from which to choose. The communication link 208 between the client devices 202, 204 may be the World Wide Web, a wireless communication link or other type of communication. The server 206 communicates with a database 210 that stores synthetic voice data for use by the server 206 to generate a synthetic voice. Those of ordinary skill in the art will understand the basic programming necessary to generate a synthetic TTS voice for use in a natural language dialog with a user. See, e.g., Huang, Acero and Hon, *Spoken Language Processing,* Prentice Hall PTR, 2001, Chapters 14-16. Therefore, the basic details of such a system are not provided herein.

It is appreciated that the location of TTS software, the location of TTS voice data, and the location of client devices are not relevant to the present invention. The basic functionality of the invention is not dependent on any specific network or network configuration. Accordingly, the system of FIG. 2 is only presented as a basic example of a system that may relate to the present invention.

Figure 3A:
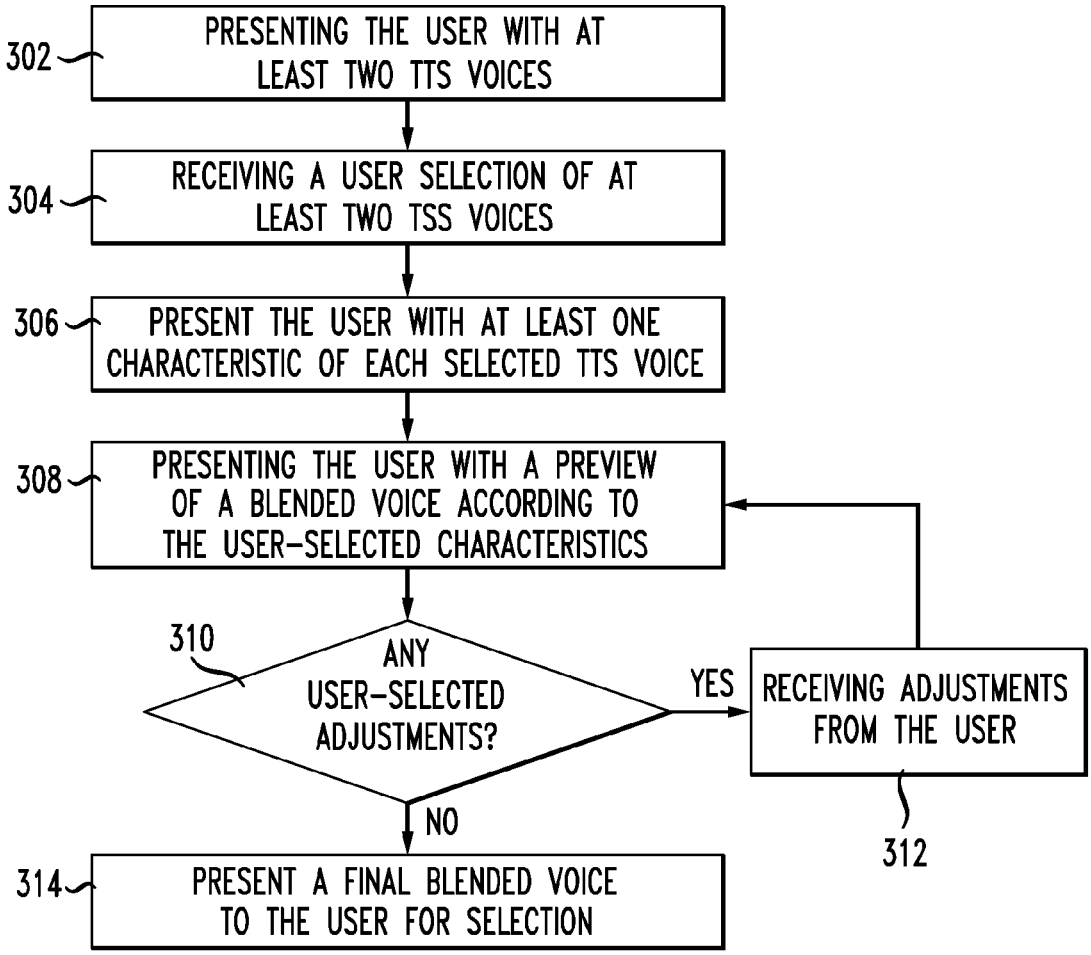
FIG. 3A shows an exemplary method according to an aspect of the present invention.

FIG. 3A shows an example method according to an aspect of the invention. The method comprises presenting the user with at least two TTS voices (302). This step, for example, may occur in the server-client model where the server presents the user via a web browser or other means with a selection of TTS voices. At least two voices are presented to the user in this aspect of the invention. The method comprises receiving the user selection of at least two TTS voices (304) and presenting the user with at least one characteristic of each selected TTS voice (306). There are a number of characteristics that may be selected but examples include accent and pitch. The system presents the user with a new blended TTS voice (308) that reflects a blend of the characteristics of the two voices. For example, if the user selected a male voice and a German voice along with an accent characteristic, the new blended voice could be a male voice with a German accent. The new blended voice would be a composite or blending of the two previously existing TTS voices.

FIG. 3A further presents the user with options to adjust the new blended voice (310). If the user adjusts the blended voice, then the method receives the adjustments from the user (312) and the method returns to step (308) to present again the adjusted blended voice to the user. If there are no user adjustments in step (310) then the method comprises presenting the user with a final blended voice for selection.

Figure 3B:
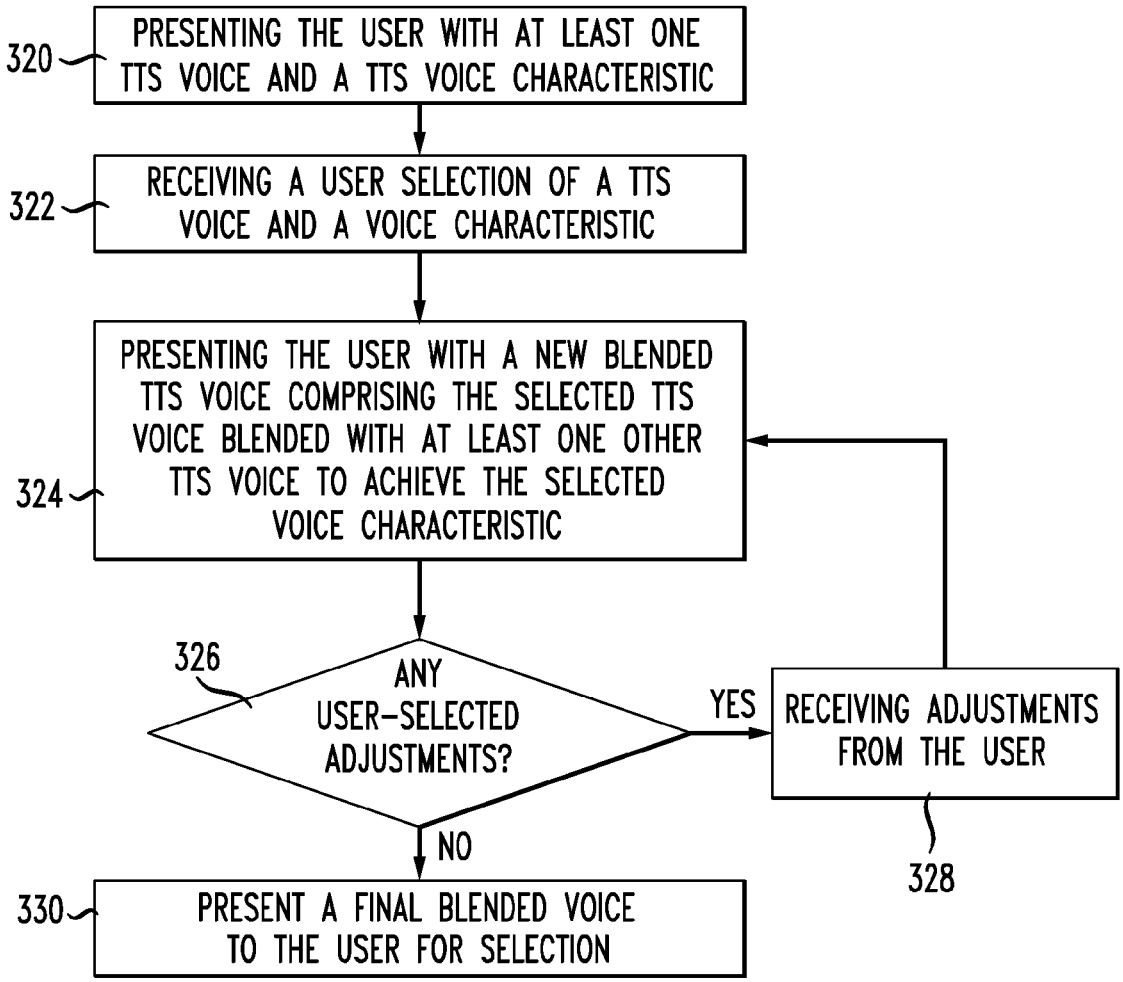
FIG. 3B shows another exemplary method according to another aspect of the invention.

FIG. 3B provides another aspect of the method of the present invention. The method in this aspect comprises presenting the user with at least one TTS voice and a TTS voice characteristic (320). The system receives a user selection of a TTS voice and the user-selected voice characteristic (322). The system presents the user with a new blended TTS voice comprising the selected TTS voice blended with at least one other TTS voice to achieve the selected voice characteristic (324). In this regard, the TTS voice characteristic is matched with a stored TTS voice to enable the blending of the presented TTS voice and a second TTS voice associated with the selected characteristic.

An example of this new blended voice may be if the user selects a male voice and a German accent as the characteristic. The new blended voice may comprise a blending of the basic TTS male voice with one or more existing TTS voices to generate the male, German accent voice. The method then comprises presenting the user with options to make any user-selected adjustments (326). If adjustments are received (328), the method comprises making the adjustments and presenting a new blended TTS voice to the user for review (324). If no adjustments are received, then the method comprises presenting a final blended voice to the user for selection (330).

The above descriptions of the basic steps according to the various aspects of the invention may be further expanded upon. For example, when the user selects a voice characteristic, this may involve selecting a characteristic or parameter as well as a value of the parameter in a voice. In this regard, the user may select differing values of parameters for a new blended voice. Examples includes a range of values for accent, pitch, friendliness, hipness, and so on. The accent may be a blend of U.K. English and U.S. English. Providing a sliding range of values of a parameter enables the user to create a preferred voice in an almost unlimited number of ways. As another example, if the parameter range for each characteristic is a range of 0 (no presence of the characteristic) to 10 (full presentation of this characteristic in the blended voice), the user could select U.K. English at a value of say 6, and U.S. English at a value of 3, and a friendliness value of 9, and so on to create their voice. Thus, the new blended voice will be a weighted average of existing TTS voices according to user-selected parameters and characteristics. As can be appreciated, in a database of TTS voices, each voice will be characterized and categorized according to its parameters for selection in the blending process.

Some of the characteristics of voices are discussed next. Accent, the "locality" of a voice, is determined by the accent of the source voice(s). For best results, an interpolated voice in U.S. English is constructed only from U.S. English source voices. Some attributes of any accent, such as accent-specific pronunciations, are carried by the TTS front-end in, for example, pronunciation dictionaries. Pitch is determined by a Pitch Prediction module with the TTS system that contributes desired pitch values to a symbolic query string for a unit selection module. The basic concept of unit selection is well known in the art. To synthesize speech, small units of speech are selected and concatenated together and further processed to sound natural. The unit selection module manages this process to select the best stored units of sound (which may be either a phoneme, diphone, etc. and may include an entire sentence).

The speech segments delivered by the unit selection module are then pitch modified in the TTS back-end. One example method of performing a pitch modification is to apply pitch synchronous overlap and add (PSOLA). The pitch prediction model parameters are trained using recording from the source voices. These model parameters can then be interpolated with weights to create the pitch model parameters for the interpolated voice. Emotions, such as happiness, sadness, anger, etc. are primarily driven by using emotionally marked sections of the recorded voice databases. Certain aspects, such as emotion-specific pitch ranges, are set by emotional category and/or user input.

Given fixed categories of accent and emotion, speech database units of different speakers in the same category can be blended in a number of different ways. One way is the following:

(a) Parameterizing the speech segments into segment parameters (for example, in terms of Linear-Predictive Coding (LPC) spectral envelopes);

(b) Interpolating between corresponding speech segmental parameters of different speakers employing weights provided by the user; and (c) Using the interpolated parameters to re-synthesize speech for the interpolated voice.

The best results when practicing the invention occur when all the speakers in a given category record the same text corpus. Further, for best results, individual speech units should be interpolated that came from the same utterances, for example, /ae/from the word "cat" in the sentence "The cat crossed the road", uttered by all the source speakers using the same emotional setting, such as "happy."

A variety of speech parameters may be utilized when blending the voices. For example, equivalent parameters include, but are not limited to, line spectral frequencies, reflection coefficients, log-area ratios, and autocorrelation coefficients. When LPC parameters are interpolated, the corresponding data associated with the LPC residuals needs to be interpolated also. Line Spectral Frequency (LSF) representation is the most widely accepted representation of LPC parameters for quantization, since they posses a number of advantages properties including filter stability preservation. This interpolation can be done, for example, by splitting the LPC residual into harmonic and noise components, estimating speaker-specific distributions for individual harmonic amplitudes, as well as for the noise components, and interpolating between them. Each of these parameters are frame-based parameters, roughly meaning that they exhibit a short time frame of around 20 ms or less.

Other parameters may also be utilized for blending voices. In addition to the frame-based parameters discussed above, phoneme-based, diphone-based, triphone-based, demisyllable-based, syllable-based, word-based, phrase-based and general or sentence-based parameters may be employed. These parameters illustrate different features. The frame-based parameters exhibit a short term spectrum, the phone-based parameters characterize vowel color, the syllable-based parameters illustrate stress timing and the general or sentence-based parameters illustrate mood or emotion.

Other parameters may include prosodic aspects to capture the specifics of how a person is saying a particular utterance. Prosody is a complex interaction of physical, phonetic effects that is employed to express attitude, assumptions, and attention as a parallel channel in speech communication. For example, prosody communicates a speaker's attitude towards the message, towards the listener, and to the communication event. Pauses, pitch, rate and relative duration and loudness are the main components of prosody. While prosody may carry important information that is related to a specific language being spoken, as it is in Mandarin Chinese, prosody can also have personal components that identify a particular speaker's manner of communicating. Given the amount of information within prosodic parameters, an aspect of the present invention is to utilize prosodic parameters in voice blending. For example, low-level voice prosodic attributes that may be blended include pitch contour, spectral envelope (LSF, LPC), volume contour and phone durations. Other higher-level parameters used for blending voices may include syllable and language accents, stress, emotions, etc.

One method of blending these segment parameters is to extract the parameter from the residual signal associated with each voice, interpolating between the extracted parameters and combining the residuals to obtain a representation of a new segment parameter representing the combination of the voices. For example, a system can extract the pitch as a prosodic parameter from each of two TTS voices and interpolate between the two pitches to generate a blended pitch.

Yet further parameters that may be utilized include speaker-specific pronunciations. These may be more correctly termed "mis-pronunciations" in that each person deviates from the standard pronunciation of words in a specific way. These deviations that relate to a specific person's speech pattern and can act like a speech fingerprint to identify the person. An example of voice blending using speaker-specific pronunciations would be a response to a user's request for a voice that sounded like their voice with Arnold Schwarzenegger's accent. In this regard, the specific mis-pronunciations of Arnold Schwarzenegger would be blended with the user's voice to provide a blended voice having both characteristics.

One example method for organizing this information is to establish a voice profile which is a database of all speaker-specific parameters for all time scales. This voice profile is then used for voice selection and blending purposes. The voice profile organizes the various parameters for a specific voice that can be utilized for blending one or more of the voice characteristics.

Embodiments within the scope of the present invention may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Those of skill in the art will appreciate that other embodiments of the invention may be practiced in network computing environments with many types of computer system configurations, including personal computers, hand-held devices, multi-processor systems, microprocessor-based or programmable consumer electronics, network PCs, mini-computers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

Although the above description may contain specific details, they should not be construed as limiting the claims in any way. Other configurations of the described embodiments of the invention are part of the scope of this invention. For example, the parameters of the TTS voices that may be used for interpolation in the process of blending voice may be any parameters, not just the LPC, LSF and other parameters discussed above. Further, other synthetic voices, not just specific TTS voices may be developed that are represented by a type of segment parameter. Accordingly, the appended claims and their legal equivalents should only define the invention, rather than any specific examples given.

We claim:

1. A method of generating a synthetic voice comprising:

receiving a user selection of a first text-to-speech (TTS) voice and a second TTS voice from a plurality of TTS voices;

receiving at least one user-selected voice characteristic; and generating a new TTS voice by blending the first TTS voice and the second TTS voice and according to the at least one user-selected voice characteristic.

2. The method of claim 1, further comprising:

presenting the new TTS voice to the user for preview;

receiving user-selected adjustments; and presenting a revised TTS voice to the user for preview according to the user-selected adjustments.

3. The method of claim 1, wherein generating the new TTS voice further comprises interpolating between corresponding segment parameters of the first TTS voice and the second TTS voice.

4. The method of claim 3, wherein the segment parameters relate to prosodic characteristics.

5. The method of claim 4, wherein the prosodic characteristics are selected from a group comprising pitch contour, spectral envelope, volume contour and phone durations.

6. The method of claim 5, wherein the prosodic characteristics are further selected from a group comprising syllable accent, language accent and emotion.

7. The method of claim 1, wherein the user-selected voice characteristic relates to mis-pronunciations.

8. The method of claim 1, wherein blending the first TTS voice and the second TTS voice further comprises extracting a prosodic characteristic from the LPC residual of the first TTS voice and the LPC residual of the second TTS voice and interpolating between the extracted prosodic characteristics.

9. The method of claim 8, wherein the prosodic characteristics is pitch, wherein the interpolation of the extracted pitches from the first TTS voice and the second TTS voice generates a new blended pitch.

10. A method of generating a synthetic voice, the method comprising:

receiving a user selection of a TTS voice and a voice characteristic; and presenting the user with a new TTS voice comprising the selected TTS voice blended with at least one other TTS voice to achieve the selected voice characteristics.

11. The method of claim 10, further comprising:

presenting the new TTS voice to the user for preview;

receiving user-selected adjustments; and presenting a revised TTS voice to the user for preview according to the user-selected adjustments.

12. The method of claim 10, wherein generating the new TTS voice further comprises interpolating between corresponding segment parameters of the first TTS voice and the at least one other TTS voice.

13. The method of claim 11, wherein the segment parameters relate to prosodic characteristics.

14. The method of claim 13, wherein the prosodic characteristics are selected from a group comprising pitch contour, spectral envelope, volume contour and phone durations.

15. The method of claim 14, wherein the prosodic characteristics are further selected from a group comprising: syllable accent, language accent and emotion.

16. The method of claim 10, wherein the blended voice is generated by extracting a prosodic characteristic from the LPC residual of the first TTS voice and the LPC residual of the second TTS voice and interpolating between the extracted prosodic characteristics.

17. The method of claim 16, wherein the prosodic characteristic is pitch and wherein the interpolation of the extracted pitches from the first TTS voice and the second TTS voice generates a new blended pitch.

18. The method of claim 10, wherein the user-selected voice is blended with a plurality of other TTS voices to generate the new TTS voice.

19. The method of claim 10, wherein the voice characteristic relates to mis-pronunciations.

20. A system for generating a synthetic voice, the system comprising:

a module for presenting a user with a plurality of TTS voices to select at least one voice characteristic;

a module for receiving a user-selected first TTS voice, a user-selected second TTS voice, and at least one user-selected voice characteristic; and a module for generating a new TTS voice by blending the first TTS voice and the second TTS voice and according to the at least one user-selected voice characteristic.

21. The system of claim 20, wherein the module that generates the new TTS voice further interpolates between corresponding segment parameters of the first TTS voice and the second TTS voice.

22. The system of claim 21, wherein the segment parameters relate to prosodic characteristics.

23. The system of claim 22, wherein the prosodic characteristics are selected from a group comprising pitch, contour, spectral envelope, volume contour and phone durations.

24. The system of claim 23, wherein the prosodic characteristics are further selected from a group comprising: syllable accent, language accent and emotion.

25. The system of claim 20, wherein blending the first TTS voice and the second TTS voice further comprises extracting a prosodic characteristic from the LPC residual of the first TTS voice and the LPC residual of the second TTS voice and interpolating between the extracted prosodic characteristics.

26. The system of claim 25, wherein the prosodic characteristic is pitch, wherein the interpolation of the extracted pitches from the first TTS voice and the second TTS voice generates a new blended pitch.

27. A method of generating a text-to-speech (TTS) voice generated by blending at least two TTS voices, the method comprising:

establishing a voice profile for each of a plurality of TTS voices, each voice profile having speaker-specific parameters;

receiving a request for a new TTS voice from a user; and generating the new TTS voice by blending speaker-specific parameters obtained from the voice profiles for at least two TTS voices.

28. The method of claim 27, wherein the speaker-specific parameters comprise at least prosodic parameters associated with each TTS voice.

29. The method of claim 28, wherein the speaker-specific parameters further comprise speaker-specific pronunciations.

30. The method of claim 27, wherein the speaker-specific parameters are related to at least one of the group comprising: frame-based, phoneme-based, syllable-based and general characteristics.

31. A test-to-speech (TTS) voice generated from a method of blending at least two TTS voices, the method comprising:

establishing a voice profile for each of a plurality of TTS voices, each voice profile having speaker-specific parameters;

receiving a request for a blended TTS voice from a user; and generating the blended TTS voice by blending speaker-specific parameters obtained from the voice profiles for at least two TTS voices.

32. The TTS voice of claim 31, wherein the speaker-specific parameters comprise at least prosodic parameters associated with each TTS voice.

33. The TTS voice of claim 32, wherein the speaker-specific parameters further comprise speaker-specific pronunciations.

34. The TTS voice of claim 33, wherein the speaker-specific parameters are related to at least one of the group comprising: frame-based, phoneme-based, syllable-based and general characteristics.

* * * * *